US005918301A

United States Patent [19]

Hasebe

[11] Patent Number: 5,918,301

[45] Date of Patent: Jun. 29, 1999

[54] MUSIC APPARATUS WITH COMPLETE REPLAY SESSION AFTER INCOMPLETE PLAY SESSION

[75] Inventor: Kiyoshi Hasebe, Hamamatsu, Japan

[73] Assignee: Yamaha Corporation, Hamahatsu, Japan

[21] Appl. No.: 09/010,643

[22] Filed: Jan. 22, 1998

[30] Foreign Application Priority Data

Jan. 27, 1997 [JP] Japan ..... 9-025743

[51] Int. Cl.[6] ..... G10H 1/06; G10H 7/00

[52] U.S. Cl. ..... 84/604; 84/622

[58] Field of Search ..... 84/601–608, 622–625

[56] References Cited

U.S. PATENT DOCUMENTS 5,559,994 9/1996 Ando ..... 84/604 X

*Primary Examiner*—Stanley J. Witkowski

*Attorney, Agent, or Firm*—Graham & James LLP

[57] ABSTRACT

A music apparatus processes a number of waveforms designated by performance information to concurrently generate the designated number of voices. In the music apparatus, an input section can provide the performance information in repeatable sessions. A computing section can compute a limited number of the waveforms in one session when the performance information is provided by the input section. A memory section memorizes the waveforms computed by the computing section. A controlling section operates in a first session if the designated number exceeds the limited number for controlling the computing section to skip computation of a remaining number of the waveforms while the computed waveforms are memorized in the memory section, and further operates in a second session for controlling the computing section to compute the remaining number of the waveforms. An output section can be enabled to concurrently generate the voices based on the designated number of the waveforms which are partly computed and memorized in the first session and partly computed in the second session.

11 Claims, 6 Drawing Sheets

MUSIC APPARATUS WITH COMPLETE REPLAY SESSION AFTER INCOMPLETE PLAY SESSION

BACKGROUND OF THE INVENTION

1. Field of the Invention

The present invention generally relates to a tone generating method of generating waveform data by computation and a music apparatus utilizing the tone generating method.

2. Description of Related Art

A conventional tone generator is composed of a MIDI (Musical Instrument Digital Interface), a performance input block for inputting performance information from a keyboard or a sequencer, a tone generating block for generating waveforms of musical tones, and a microprocessor (hereafter, referred to as CPU) for controlling the tone generating block according to the inputted performance information. The CPU executes tone generating driver process including channel assignment and parameter conversion according to the inputted performance information. Further, the CPU supplies information about the converted tone generating parameters and information about sounding start command (namely, note-on) to channels assigned in the tone generating block. The tone generating block is constituted by electronic circuits (namely, hardware) including an LSI (Large Scale Integrated Circuit), and generates waveforms of musical tones or voices based on the supplied tone generating parameters. Therefore, the conventional tone generator is dedicated to generation of musical tones or voices. This requires to separately prepare a dedicated tone generator to generate tones in a personal computer, for example.

To solve this problem, a software sound source has been proposed in which a tone generating program is run by the CPU to generate tones based on this program. This software sound source is implemented by a general-purpose computation processing unit (namely, a computer) that can execute application programs such as a game program in addition to the tone generating application program.

FIG. 7 is a block diagram illustrating constitution of a tone generator having the software sound source as described above. In FIG. 7, when a note-on event occurs (not shown in the figure), a central processing unit (CPU) 100 performs computation according to a tone generating program 101 to generate waveform data, and temporarily stores the generated waveform data in a buffer 102. A digital/analog (D/A) converter 103 reads the waveform data from the buffer 102 every time a predetermined D/A conversion moment comes, and converts the read waveform data into an analog waveform signal. The resultant analog waveform signal is supplied to a sound system 104 to be sounded.

However, in the tone generator having the software sound source as described above, a number of tones or voices to be sounded simultaneously depends on the processing speed of the CPU 100 and the processing quantity and sampling frequency fs for generating one sample of the waveform data. For example, given sampling frequency fs=48 kHz, then one sample period is 20.8 ms. All necessary waveform data per one sample must be computed in this sampling period. Actually, however, 20.8 ms cannot be used all by the tone generator because the operating system (OS) takes time for its operation. Moreover, if another application is running, the execution time for that application is required.

In a monophonic sound, one sample of waveform data may only be computed during one sampling period. With a polyphonic sound, it is required to compute waveform data for the same number of samples as the number of musical tones being sounded concurrently at an allocated time. Thus, in case of the polyphonic sound, a computational time allocated for generating one sample of waveform data is decreased. Generally, music is played by use of plural sounding channels, so that a computation time allocated to one sounding channel is shortened. In a short computation time, only simple computation can be performed, thereby preventing tone quality from being enhanced. In programming of a tone generation algorithm for use in a software sound source, it is sometimes required to evaluate a music tone not monophonically but polyphonically. However, if the tone generation algorithm is made complicated, the computation for plural sounding channels may not be completed within an allocated computation time, thereby failing to polyphonically reproduce the music tone for evaluation.

SUMMARY OF THE INVENTION

It is therefore an object of the present invention to provide a tone generating method capable of generating a polyphonic tone at replay later if computation for plural sounding channels is not completed within a processing time at initial play, and to provide a music apparatus based on such a tone generating method.

The inventive method concurrently processes a number of waveforms designated by performance information to generate the designated number of musical tones. The inventive method comprises a play process which can concurrently process a limited number of the waveforms when the performance information is provided, and a replay process which can concurrently process the waveforms when the performance information is again provided. The play process comprises the steps of producing the limited number of the waveforms by computation while skipping a remaining number of the waveforms if the designated number exceeds the limited number, and memorizing the produced waveforms in a memory. The replay process comprises the steps of producing the skipped number of the waveforms by computation while reproducing the memorized number of the waveforms by access to the memory to thereby provide the designated number of the waveforms, and generating the musical tones based on the provided waveforms. Preferably, the inventive method further comprises a next replay process which is commenced if the replay process has failed to complete production of the skipped number of the waveforms by computation.

The inventive apparatus processes a number of waveforms designated by performance information to concurrently generate the designated number of voices. In the inventive apparatus, an input section can provide the performance information in repeatable sessions. A computing section can compute a limited number of the waveforms in one session when the performance information is provided by the input section. A memory section memorizes the waveforms computed by the computing section. A controlling section operates in a first session if the designated number exceeds the limited number for controlling the computing section to skip computation of a remaining number of the waveforms while the computed waveforms are memorized in the memory section, and further operates in a second session for controlling the computing section to compute the remaining number of the waveforms. An output section can be enabled to concurrently generate the voices based on the designated number of the waveforms which are partly computed and memorized in the first session and partly computed in the second session. Preferably, the controlling section controls the input section to commence a third session if the computing section is unable to complete the computation of the remaining number of the waveforms in the second session. In such a case, the controlling section may disable the output section in the second session to mute generation of the voices. Preferably, the controlling section disables the output section in the first session to mute generation of the voices. Preferably, the controlling section controls the input section to repeatedly commence silent sessions until the computation of the designated number of the waveforms completes while disabling the output section in each silent session to mute generation of the voices, and then controls the input section to commence an audible session while enabling the output section so as to concurrently generate the designated voices.

The inventive music apparatus processes a number of waveforms designated by performance information to concurrently generate the designated number of musical tones. In the inventive music apparatus, input means is provided for inputting the performance information separately in a play session and a replay session. Computing means is provided for synthesizing a limited number of the waveforms by computation in the play session according to the inputted performance information. Memory means is provided for memorizing the waveforms synthesized by the computing means. Controlling means operates in the play session where the designated number exceeds the limited number for controlling the computing means to skip synthesis of a remaining number of the waveforms while the synthesized waveforms are memorized in the memory means, and operates in the replay session for controlling the computing means to synthesize the remaining number of the waveforms. Output means is provided for concurrently outputting the musical tones based on the designated number of the waveforms which are partly synthesized and memorized in the play session and partly synthesized in the replay session. Preferably, the controlling means comprises means for controlling the input means to commence a next replay session if the computing means has failed to complete the synthesis of the remaining number of the waveforms in the replay session.

The inventive machine readable medium is used in a music apparatus having a CPU for concurrently processing a number of waveforms designated by performance information to generate the designated number of musical tones. The medium contains program instructions executable by the CPU for causing the music apparatus to perform the steps of a play process which can concurrently process a limited number of the waveforms when the performance information is provided, and a replay process which can concurrently process the waveforms when the performance information is again provided. The play process comprises the substeps of producing the limited number of the waveforms by computation while skipping a remaining number of the waveforms if the designated number exceeds the limited number, and memorizing the produced waveforms in a memory. The replay process comprises the substeps of producing the skipped number of the waveforms by computation while reproducing the memorized number of the waveforms by access to the memory to thereby provide the designated number of the waveforms, and generating the musical tones based on the provided waveforms. Preferably, the steps further comprise a next replay process which is commenced if the replay process has failed to complete production of the skipped number of the waveforms by computation.

According to the present invention, the tone waveform data generated by computation in the play process or the first session is stored in the waveform memory. In the replay process or the second session, if the waveform data corresponding to performance information is stored in the waveform memory, that corresponding data is read from the memory. If the waveform data corresponding to the performance information is not stored in the waveform memory, or the waveform data is not generated by computation in the play process, that waveform data is generated by computation in the replay process. Therefore, when the simultaneous sounding of plural tones is commanded by the performance information, if the waveform data for all the tones cannot be generated by computation in the initial play process, the subsequent replay process is executed to allow sounding of the tones according to the waveform data generated by computation in the replay process in addition to the tones of the waveform data generated by computation in the play process. Thus, the novel constitution allows simultaneous sounding of all tones from plural channels of the tone generator according to the performance information.

BRIEF DESCRIPTION OF THE DRAWINGS

These and other objects of the invention will be seen by reference to the description, taken in connection with the accompanying drawings, in which.

DETAILED DESCRIPTION OF PREFERRED EMBODIMENTS

This invention will be described in further detail by way of example with reference to the accompanying drawings.

Figure 1:
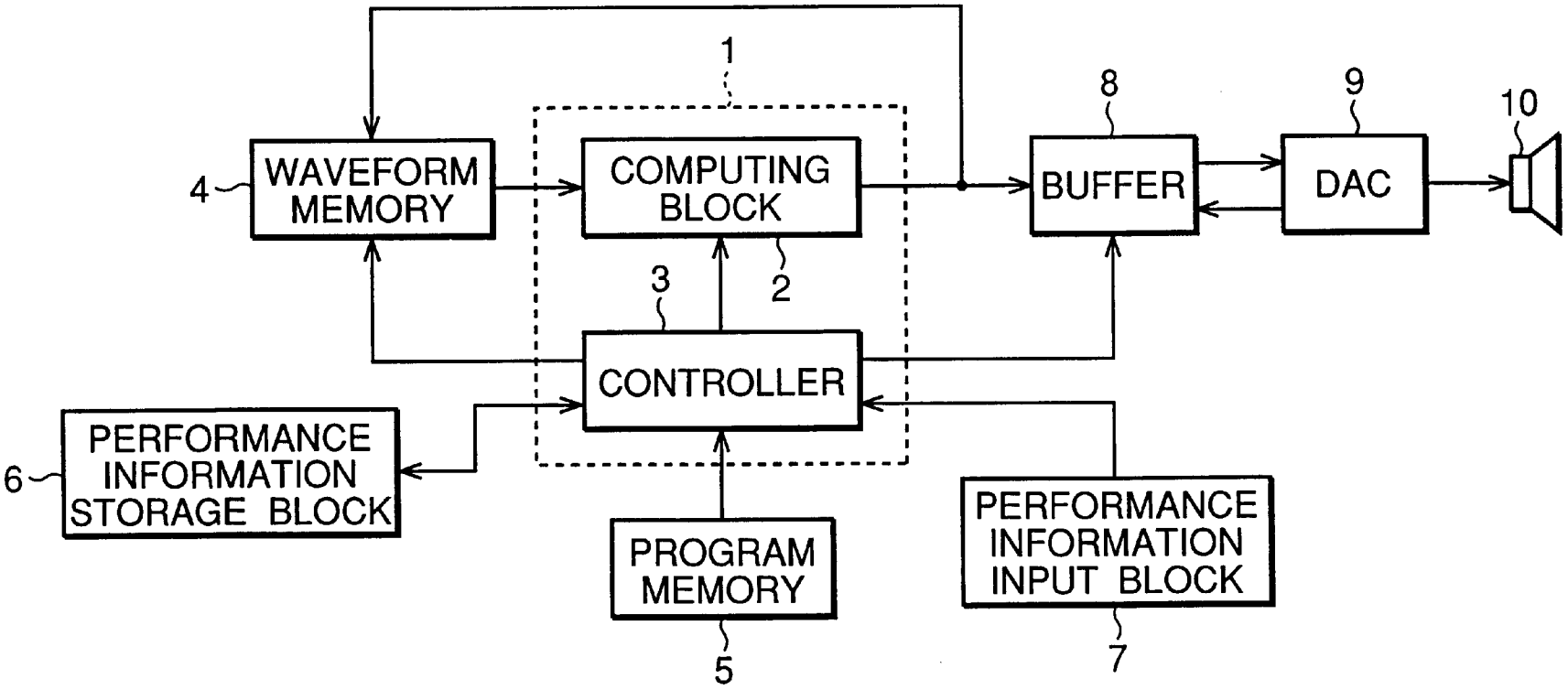
FIG. 1 is a block diagram illustrating constitution of a tone generating apparatus practiced as one preferred embodiment of the present invention.

Now referring to FIG. 1, there is shown a block diagram illustrating a tone generating apparatus or a music apparatus practiced as one preferred embodiment of the present invention. The tone generating apparatus is based on a tone generating method according to the present invention. In the figure, a processing block 1 executes a program stored in a program memory 5 to generate tone waveform data by computation, and modifies tone waveform data with an effect imparted. The processing block 1 is based on a central processing unit (CPU), and includes a computing block 2 for generating tone waveform data and for processing the tone waveform data with an effect imparted, and a controller 3 for controlling the computation of the computing block 2 by performance information, for example.

A waveform memory 4 stores the tone waveform data generated by the computing block 2, and supplies the stored data to the computing block 2 under the control of the controller 3. The program memory 5 stores a program to be executed by the processing block 1. The program memory 5 may be a machine readable medium such as a floppy disk and a CD-ROM disk. A storage block 6 stores all performance information inputted from a performance information input block 7. From the storage block 6, the performance information is read under the control of the controller 3 in a replay process. The replay process or replay session based on the read performance information is executed by the computing block 2. The input block 7 further inputs performance information associated with a keyboard, a sequencer, or a MIDI input.

Reference numeral 8 denotes a buffer for temporarily storing the tone waveform data generated by the computing block 2. Reference numeral 9 denotes a digital/analog converter (DAC) that requests the buffer 8 for data in each sampling period. The DAC 9 converts the tone waveform data supplied from the buffer 8 into an analog tone waveform signal, and supplies the analog tone waveform signal to a sound system 10.

The following describes the operation of the tone generating apparatus constituted as described above. When performance information is inputted from the performance information input block 7 into the controller 3, play process starts as a first session. The performance information is stored in the performance information storage block 6, and the computing block 2 is controlled by the controller 3 based on the performance information. For example, if the performance information indicates a note-on event, the computing block 2 generates the waveform data for a predetermined number of samples. If simultaneous sounding of plural tones is specified in the performance information, the waveform data for the number of samples that can be generated within the allocated computation time is generated by computation. The remaining waveform data that cannot be generated within the computation time is not generated. Therefore, even if the sounding of plural tones is specified or requested, the waveform data corresponding to the specified number of simultaneous tones may not be generated at the initial play session.

The waveform data thus generated in the computing block 2 is sent to the buffer 8 to store the waveform data. At the same time, the generated waveform data is also stored in the waveform memory 4. From the buffer 8, the waveform data is read on request by the digital/analog converter (DAC) 9. The read waveform data is converted by the DAC 9 into an analog signal in every sampling period, and is supplied to the sound system 10. Then, this analog signal is sounded from the sound system 10.

The play process is continuously executed as long as the performance information input block 7 continues music performance. When the music performance comes to an end, all the performance information are stored in the performance information storage block 6 for reuse. All the waveform data generated by the computing block 2 are stored in the waveform memory 4 for reuse.

If the replay process follows the play process in the above-mentioned state, the performance information is sequentially read from the performance information storage block 6, and is supplied to the processing block 1. In the processing block 1, tone generation or synthesis is executed by use of the waveform data stored in the waveform memory 4. For example, if the performance information indicates a note-on event, it is determined whether the waveform data corresponding to that performance information has been stored in the waveform memory 4. If the waveform data is stored, the waveform data is read from the waveform memory 4, and is sent to the buffer 8 as it is without change. If the waveform data is not stored in the waveform memory 4, waveform data synthesis or computation is newly executed in the computing block 2, and the synthesized waveform data is sent to the buffer 8. It should be noted that, in this waveform data computation, the waveform data for the number of samples that can be generated within an allocated computation time is generated by computation, and the remaining waveform data that cannot be generated within the allocated computation time is not generated. Thus, in the replay process, the waveform data corresponding to the performance information for which waveform data computation has not been executed at the play process is generated by computation.

Consequently, in the replay process, only the processing for reading the waveform data from the waveform memory 4 may be executed for the performance information for which waveform data generation has been executed at the play processing, thereby reducing the processing quantity. The resulting margin of time is allocated to the waveform data generation for the performance information for which the waveform data generation has not been executed at the play process. As a result, when the sounding of plural tones is specified, the waveform data for the sounding of plural tones can be generated at the replay process, thereby sounding the plural tones simultaneously.

If generation of all waveform data for sounding of plural tones specified by the performance information cannot be completed in the first replay process, the next or second replay process is executed. The generation of the waveform data not yet generated may be executed in this second replay process. Namely, the replay process is repeated until all the waveform data for the specified tones are finally synthesized. Therefore, when the last replay process has been executed, the generation of all the waveform data corresponding to the specified tones comes to be completed. At this last replay session, all the specified tones or voices can be sounded.

Figure 2:
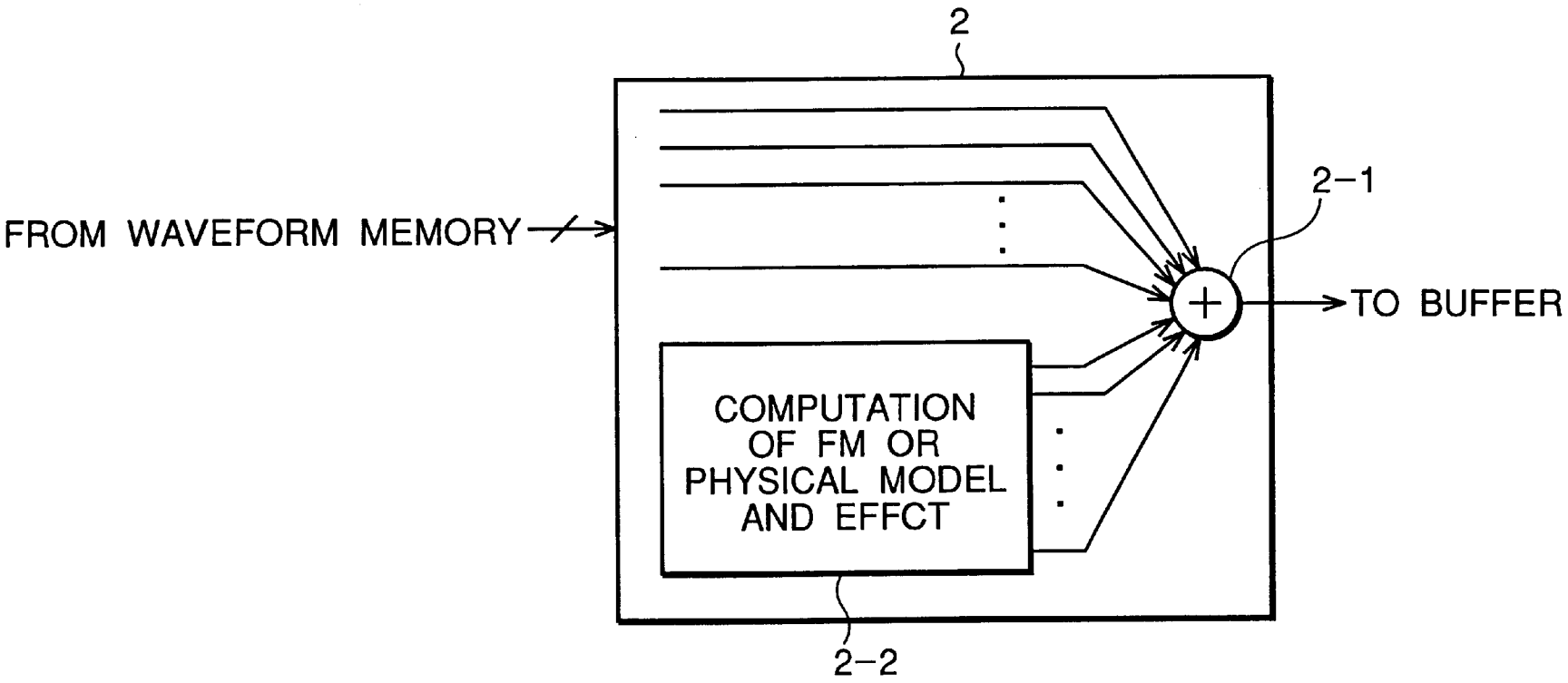
FIG. 2 is a diagram for describing operation of a waveform computation block associated with the present invention.

The operation of the computing block 2 in the replay process to be executed by the processing block 1 is illustrated in FIG. 2 in hardware approach. In the figure, an adder 2-1 adds plural channels of tone waveform data read from the waveform memory 4 and tone waveform data computed by a sound source computing block 2-2 together. The plural channels of the tone waveform data outputted from the adder 2-1 is supplied to the buffer 8 to be temporarily stored. The sound source computing block 2-2 executes tone generation computation such as FM tone generating computation, physical model tone generating computation and wave table tone generating computation based on the supplied performance information to generate tone waveform data and computational processing for imparting an effect to the tone waveform data, thereafter supplying the processed tone waveform data to the adder 2-1. It should be noted that, actually, the computing block 2 executes the computation for channels in a time division manner. Therefore, every time the tone waveform data of one channel is generated, the computing block 2 adds this tone waveform data to the tone waveform data of another channel already computed.

Referring back to FIG. 1, the inventive apparatus processes a number of waveforms designated by performance information to concurrently generate the designated number of tones or voices. In the inventive apparatus, the input section 7 can provide the performance information in repeatable sessions. The computing section 2 can compute a limited number of the waveforms in one session when the performance information is provided by the input section 7. The memory section 4 memorizes the waveforms computed by the computing section 2. The controlling section 3 operates in a first session if the designated number exceeds the limited number for controlling the computing section 2 to skip computation of a remaining number of the waveforms while the computed waveforms are memorized in the memory section 4, and further operates in a second session for controlling the computing section 2 to compute the remaining number of the waveforms. An output section including the buffer 8, DAC 9 and sound system 10 can be enabled to concurrently generate the voices based on the designated number of the waveforms which are partly computed and memorized in the first session and partly computed in the second session. Preferably, the controlling section 3 controls the input section 7 or the storage 6 to commence a third session if the computing section 2 is unable to complete the computation of the remaining number of the waveforms in the second session. In such a case, the controlling section 3 may disable the output section in the second session to mute generation of the voices. Preferably, the controlling section 3 disables the output section in the first session to mute generation of the voices. Preferably, the controlling section 3 controls the input section 7 or the storage 6 to repeatedly commence silent sessions until the computation of the designated number of the waveforms completes while disabling the output section in each silent session to mute generation of the voices, and then controls the input section 7 or the storage 6 to commence an audible session while enabling the output section so as to concurrently generate the designated voices.

Figure 3:
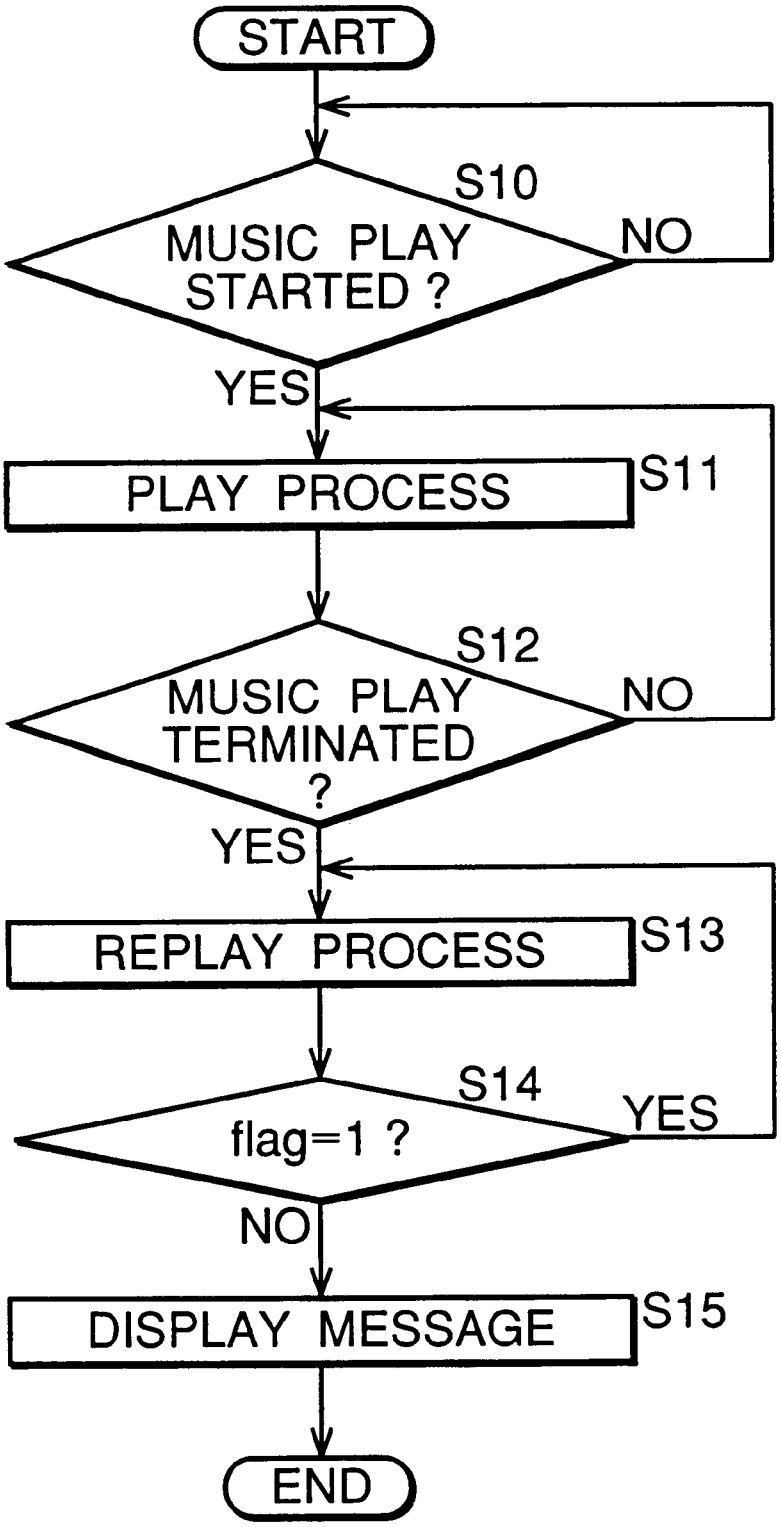
FIG. 3 is a flowchart of a main routine in a tone generating method associated with the present invention.

The following describes operation of the tone generating apparatus constituted as described above with reference to a flowchart shown in FIG. 3. This flowchart describes a main routine executed by the processing block 1 and started for execution at each predetermined period. When the main routine starts, it is determined in step S10 whether music play has started or not. If no play has started (NO), this processing is repeated until the music play starts. If the music play has started (YES), then, in step S11, the play process is executed. This play process is repeated until the music play is terminated in step S12.

If the music play is found terminated, the processing goes from step S12 to step S13, in which the replay process is executed. This replay process is repeated until the waveform data for all tones to be sounded are generated. Whether the waveform data for all tones to be sounded has been generated or not is indicated by a flag. If this flag is "1," it indicates that the waveform data of all tones are not generated. If this flag is "0," it indicates that the waveform data for all tones to be sounded have been computed. Therefore, if the flag is found "0" in step S14, the computation of the waveform data for all tones to be sounded has been completed. Then, the processing goes from step S14 to step S15. In step S15, a message "All channels sounded" for example is indicated on a display panel, upon which the main routine comes to an end.

Figure 4:
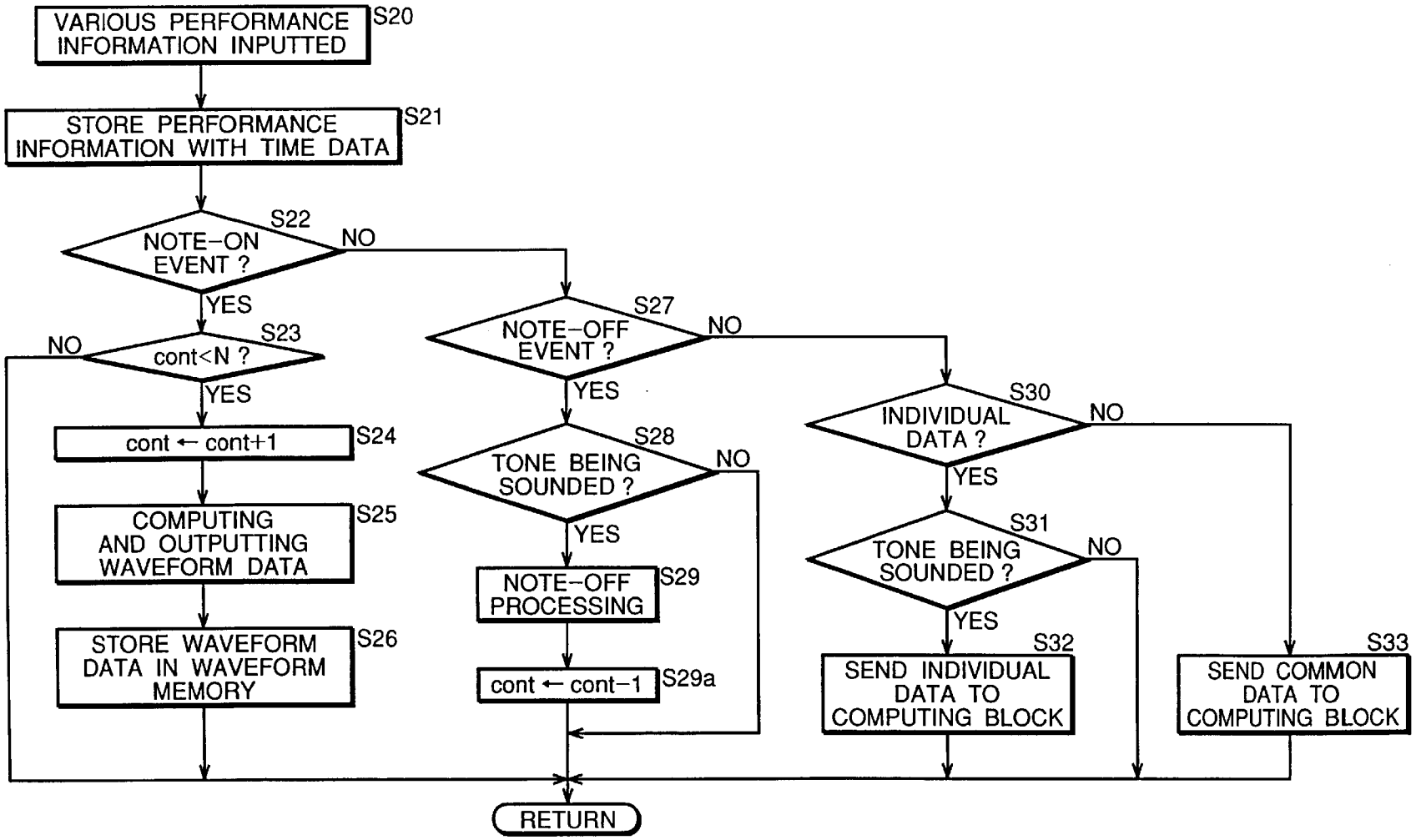
FIG. 4 is a flowchart of play process to be executed in the tone generating method associated with the present invention.

The following describes the play process to be executed in step S11 with reference to a flowchart shown in FIG. 4 and the block diagram of the tone generating apparatus shown in FIG. 1. When performance information is inputted from the performance information input block 7 in step S20, the play process starts. In step S21, this performance information is stored in the performance information storage block 6 along with time data indicating time sequence of each event involved in the performance information. Then, in step S22, it is determined whether the captured performance information indicates a note-on event. If the performance information is found a note-on event (YES), then, in step S23, it is determined whether a tone number count cont is in excess of the maximum computable number N of simultaneously sounded tones. The number N is computed by separate processing (not shown in the figure). Otherwise, the number N is set variably according to capacity of the used CPU. This tone number count cont indicates the number of tones being computed (or sounded) in the processing of computation at the current point of time, default being zero. Therefore, at first, the tone number count cont is zero, so that the decision is YES in step S23. Then, the processing goes to step S24.

In step S24, the tone number count cont is incremented by one. In step S25, tone generating computation is executed by the computing block 2 based on the note-on event. The generated waveform data is outputted to the external buffer 8. In step S26, the generated waveform data is stored in the waveform memory 4, upon which the processing returns.

It is assumed that the maximum computable number N of simultaneously sounded tones is 2, while three note-on events to be sounded simultaneously are incidentally inputted from the performance information input block 7. At this time, the first note-on event is captured as described above. The waveform data corresponding to the first note-on event is generated by computation in step S25, and is stored in the buffer 8. At the same time, the generated waveform data is stored in the waveform memory 4. At this moment, the tone number count cont is set to 1. Then, the processing returns to step S12 shown in FIG. 3. Because the music play has not been terminated, the play process is started again, upon which the second note-on event is captured. In step S25, the waveform data corresponding to the second note-on event is generated by computation by the computing block 2 and stored in the buffer 8. In step S26, the generated data is memorized in the waveform memory 4. At this moment, the tone number count cont is set to 2.

The processing returns to step S12 shown in FIG. 3 again. Because the music play has not yet been terminated, the play process is started again to capture the third note-on event. However, because the maximum computable number N of simultaneously sounded tones is 2, the decision is NO in step S23. Therefore, no waveform data is generated by computation and the processing returns. Namely, only two tones are sounded in the play process.

If the performance information is not found a note-on event in step S22, the processing branches to step S27, in which it is determined whether the performance information is a note-off event. If the performance information is found a note-off event (YES), then, in step S28, it is determined whether the note-off event is for the tone currently being sounded. If the decision is YES, then, in step S29, note-off processing is executed on the tone being sounded. Further, the value of cont is decremented by one in step S29*a*. Then, the processing returns. If the decision is NO, then the processing returns while skipping step S29.

If, in step S27, the performance information is not found a note-off event (NO), the processing branches to step S30, in which it is determined whether the performance information is data for an individual sounding channel or data common to the sounding channels. If the performance information is found the data for an individual sounding channel (YES), then, in step S31, it is determined whether the individual data is for the tone being sounded. If the data is found for the tone being sounded (YES), then, in step S32, the individual data is sent to the computing block 2 such that the individual data is reflected onto the tone being sounded. Then, the processing returns. Based on the supplied data, the computing block 2 generates waveform data. If, in step S31, the individual data is not found for the tone being played (NO), the processing skips step S32 and returns.

If, in step S30, the inputted performance information is found the common data (NO), then the processing branches to step S33. In step S33, the common data is sent to the computing block 2 to be reflected onto all tones being played.

Figure 6:
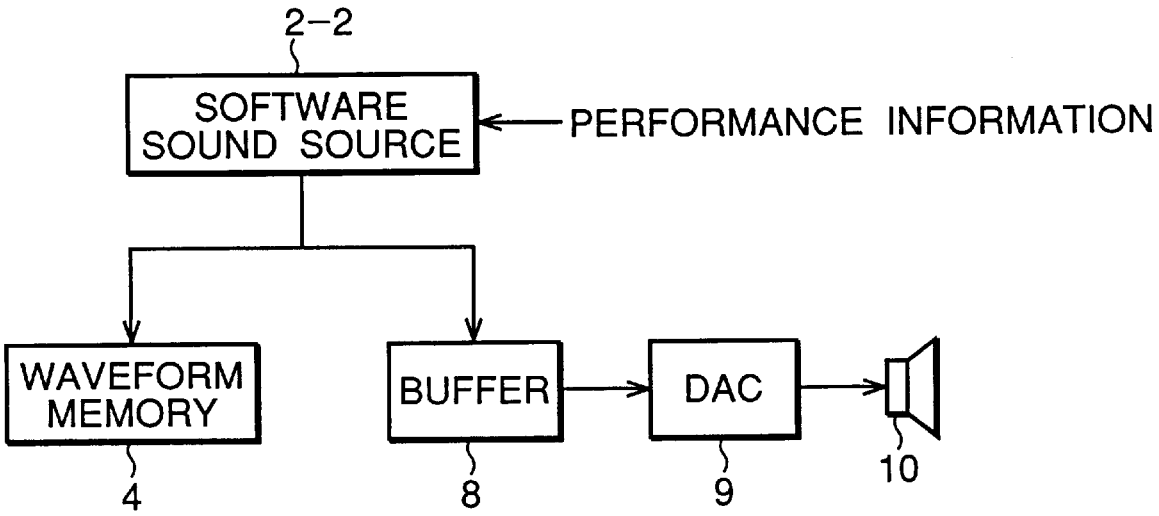
FIG. 6 is a block diagram illustrating hardware construction of the waveform computation block used by the tone generating method associated with the present invention.
Figure 7:
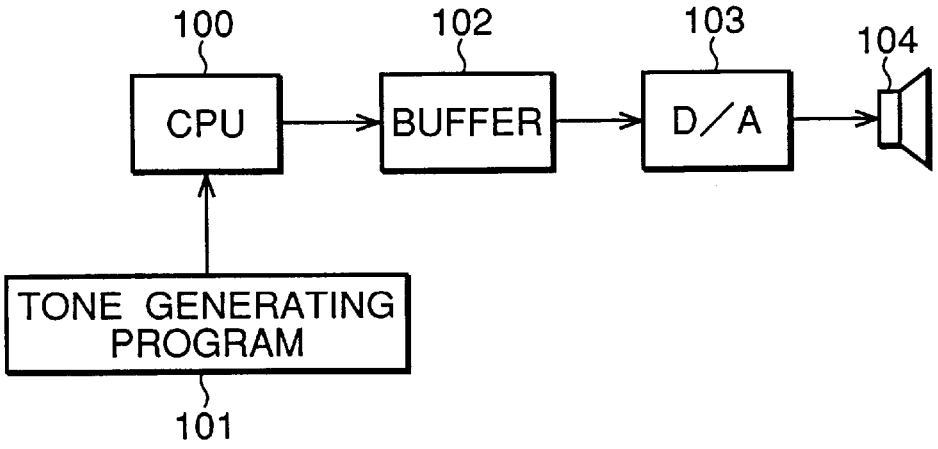
FIG.7 PRIOR ART
FIG. 7 is a block diagram illustrating constitution of a prior art tone generating apparatus.

It should be noted that the computing block is actually a software sound source executed in the computing block 2. This software sound source is represented equivalently by a hardware construction as shown in FIG. 6. The sound source 2-2 generates waveform data based on the supplied performance information, and sends the generated waveform data to the waveform memory 4 and to the buffer 8.

Figure 5:
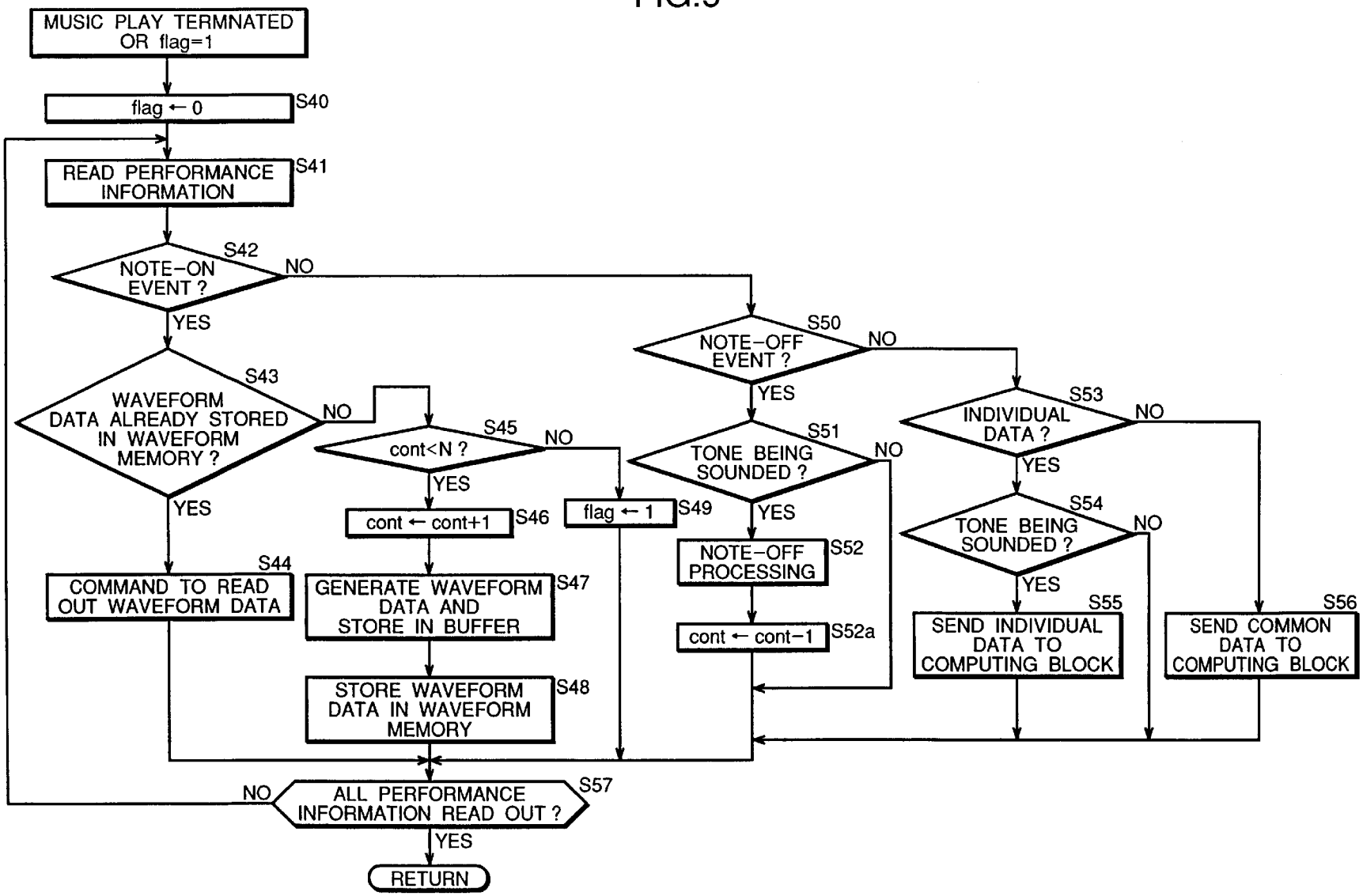
FIG. 5 is a flowchart of replay process to be executed in the tone generating method associated with the present invention.

The following describes the replay process to be executed in step S13 with reference to the flowchart shown in FIG. 5 and the block diagram of the tone generating apparatus shown in FIG. 1.

When the music play has been terminated or the flag turns to "1," the replay process starts. At the same time, the flag is reset to "0" in step S40. Next, in step S41, performance information that has reached a sounding time is sequentially read from the performance information storage block 6 or again supplied from the input block 7. In step S42, it is determined whether the read performance information is a note-on event. If the performance information is found a note-on event (YES), then, in step S43, it is determined whether the waveform data corresponding to the performance information of the note-on event has already been stored in the waveform waveform memory 4. If, at this moment, the waveform data generated in the play process has been stored in the waveform memory 4, the decision is YES and the processing goes to step S44 to command reading of the waveform data from the waveform memory 4.

Next, in step S57, it is determined whether the performance information has all been read from the performance information storage block 6 which functions as the input section in the replay process instead of the input block 7. If the performance information is found all read out, the processing returns. Otherwise, the processing goes back to step S41. Step S41 and subsequent steps are repeated.

Sometimes, the number of tones more than the maximum computable number N of simultaneously sounded tones has been specified in the last play, and all waveform data has not been generated in the last play process. Namely, if three note-on events have simultaneously occurred at the last play and the waveform data for the third note-on event has not been generated in the last play process, the decision is NO in step S43 and the processing branches to step S45. In step S45, it is determined whether the tone number count cont exceeds the maximum computable number N of simultaneously sounded tones. This tone number count cont indicates the number of tones being computed (or sounded) in the processing at the current computation, default being zero. Immediately after starting the replay process, the tone number count cont is zero as default, so that the decision is YES in step S45 and the processing goes to step S46.

In step S46, the tone number count cont is incremented by one and the processing goes to step S47. In step S47, tone generating computation is executed by the computing block 2 based on the note-on event. The generated waveform data is outputted to the external buffer 8. Then, the generated waveform data is stored in the waveform memory 4 in step S48 and the processing goes to step S57. In step S57, it is determined whether the performance information has all been read from the performance information storage block 6. If the performance information is found all read, the processing returns. Otherwise, the processing goes back to step S41. Step S41 and subsequent steps are repeated.

If, in step S45, the tone number count cont is found in excess of the maximum computable number N of simultaneously sounded tones, the processing branches to S49, in which the flag is set to "1." Then the processing goes to step S57.

It is assumed now that the maximum computable number N of simultaneously sounded tones is 2 for example, and three note-on events to be sounded simultaneously have been inputted from the performance information input block 7 at the last play process. In this case, as described before, the waveform data for the tones corresponding to the first and second note-on events are stored in the waveform memory 4 by the play process. Therefore, the waveform data corresponding to the first and second note-on events read from the performance information storage 6 are read from the waveform memory 4 in step S44. When the performance information associated with the third note-on event is read from the performance information storage block 6, the decision is NO in step S43 and the processing goes to step S47. In step S47, the waveform data for the third note-on event is generated, and is stored in the buffer 8 and in the waveform memory 4.

Thus, the three tones specified at the play process can be sounded simultaneously in the replay process. In the above-mentioned example, the maximum computable number N of simultaneously sounded tones is set to 2. It will be apparent that the number N may be set to 3 or higher dependently on current work load of CPU.

Meanwhile, if the simultaneous sounding of four tones is specified at the music play with the maximum computable number N of simultaneously sounded tones being set to 2, the waveform data for the tones corresponding to the first and second note-on events are generated by the play process and stored in the waveform memory 4. The waveform data for the tones corresponding to the third and fourth note-on events are generated by the replay process and stored in the buffer 8 and in the waveform memory 4. Consequently, the replay process can simultaneously sound the four tones or voices specified or designated in the play process.

Further, if the simultaneous sounding of five tones is specified in the play process, the waveform data for the tones corresponding to the first and second note-on events are generated by the play process and stored in the waveform memory 4. The waveform data for the tones corresponding to the third and fourth note-on events are generated by the first replay process and stored in the buffer 8 and in the waveform memory 4. However, when the fifth note-on event is read, the decision is NO in step S45, so that the waveform data for the fifth note-on event cannot be generated. In this case, the flag is set to "1" and the processing returns. Therefore, back in step S14 shown in FIG. 3, the decision is YES and the second replay process starts as a next replay session. In this session, the tone number count cont is initially set default, so that, when the fifth note-on event is read from the performance information storage block 6, the waveform data for the fifth note-on event is generated in step S47. Thus, the second replay process can simultaneously sound all the specified five tones. Therefore, by repeating the replay process multiple times, many tones can be sounded simultaneously.

If the performance information is found not a note-on event in step S42, the processing branches to step S50. The processing of step S50 through step S56 is the same as that of step S27 through step S33 in the play process shown in FIG. 4. The processing of step S50 through step S56 executes note-off processing, individual processing to each sounding channel, and common processing to all sounding channels.

In the tone generating method and the music apparatus according to the present invention, processing may include sounding instructions requested by other application programs by use of an idle time of the tone generation computing processing. These application programs include a game program, a communication program, and a clerical work program.

In the present invention described so far, if there is a difference between the number of tones to be simultaneously sounded according to the performance information and the number of tones to be actually replayed (a total of the number of tones read from the waveform memory and the number of tones generated by computation), the listener may have sense of unnaturalness when the deficient replay tones are sounded from the sound system 10. If the number of tones to be simultaneously sounded does not match the number of tones to be actually reproduced, the output of the sound system 10 may be muted. Also, if the performance information is known beforehand, the present invention may be practiced by reading the performance information beforehand with the tone being muted. In this case, the processing is executed until the maximum computable number of simultaneously sounded tones matches the specified number of tones to be simultaneously sounded. This preprocessing allows satisfactory replay of the specified number of tones to be simultaneously sounded if the output of tones or voices from application software or the like is specified by the user.

As described above, the inventive method concurrently processes a number of waveforms designated by performance information to generate the designated number of musical tones. The inventive method comprises a play process which can concurrently process a limited number of the waveforms when the performance information is provided, and a replay process which can concurrently process the waveforms when the performance information is again provided. The play process comprises the steps of producing the limited number of the waveforms by computation while skipping a remaining number of the waveforms if the designated number exceeds the limited number, and memorizing the produced waveforms in a memory. The replay process comprises the steps of producing the skipped number of the waveforms by computation while reproducing the memorized number of the waveforms by access to the memory to thereby provide the designated number of the waveforms, and generating the musical tones based on the provided waveforms. Preferably, the inventive method further comprises a next replay process which is commenced if the replay process has failed to complete production of the skipped number of the waveforms by computation.

So far, the tone generating method according to the present invention has been described as a program that is executed on the music apparatus shown in FIG. 1. The program described with this tone generating method can also be recorded on a machine readable medium such as a floppy disk and a CD-ROM disk. This program can be installed from the medium onto a general-purpose computer that runs Windows (a personal computer OS by Microsoft Corp.) or other operating systems, as one application program being executed concurrently with other application programs on the computer. The inventive machine readable medium is used in a music apparatus having a CPU for concurrently processing a number of waveforms designated by performance information to generate the designated number of musical tones. The medium contains program instructions executable by the CPU for causing the music apparatus to perform the steps of a play process which can concurrently process a limited number of the waveforms when the performance information is provided, and a replay process which can concurrently process the waveforms when the performance information is again provided. The play process comprises the substeps of producing the limited number of the waveforms by computation while skipping a remaining number of the waveforms if the designated number exceeds the limited number, and memorizing the produced waveforms in a memory. The replay process comprises the substeps of producing the skipped number of the waveforms by computation while reproducing the memorized number of the waveforms by access to the memory to thereby provide the designated number of the waveforms, and generating the musical tones based on the provided waveforms. Preferably, the steps further comprise a next replay process which is commenced if the replay process has failed to complete production of the skipped number of the waveforms by computation.

As described and according to the present invention, all waveform data generated by computation in the first or play process is stored in the waveform memory beforehand. In the second or replay process, if the waveform data corresponding to the performance information is stored in the waveform memory, the waveform data is read out from the waveform memory. If the waveform data corresponding to the performance information is not stored in the waveform memory, or the waveform data has not been generated in the play process, the waveform data is generated in the replay process. Consequently, if the simultaneous sounding of plural tones is specified by the performance information and the waveform data for all tones cannot be generated in the play process, the replay process is executed to allow sounding of the tones according to the waveform data generated in the replay process in addition to the tones according to the waveform data generated in the play process, thereby sounding all the tones of the plural sounding channels specified by the performance information.

While the preferred embodiments of the present invention have been described using specific terms, such description is for illustrative purposes only, and it is to be understood that changes and variations may be made without departing from the spirit or scope of the appended claims.

What is claimed is:

1. A method of concurrently processing a number of waveforms designated by performance information to generate the designated number of musical tones, the method comprising:

a play process which can concurrently process a limited number of the waveforms when the performance information is provided, and a replay process which can concurrently process the waveforms when the performance information is again provided, wherein the play process comprises the steps of producing the limited number of the waveforms by computation while skipping a remaining number of the waveforms if the designated number exceeds the limited number, and memorizing the produced waveforms in a memory, and wherein the replay process comprises the steps of producing the skipped number of the waveforms by computation while reproducing the memorized number of the waveforms by access to the memory to thereby provide the designated number of the waveforms, and generating the musical tones based on the provided waveforms.

2. A method according to claim 1, further comprising a next replay process which is commenced if the replay process has failed to complete production of the skipped number of the waveforms by computation.

3. An apparatus for processing a number of waveforms designated by performance information to concurrently generate the designated number of voices, the apparatus comprising:

an input section that can provide the performance information in repeatable sessions;

a computing section that can compute a limited number of the waveforms in one session when the performance information is provided by the input section;

a memory section that memorizes the waveforms computed by the computing section;

a controlling section that operates in a first session if the designated number exceeds the limited number for controlling the computing section to skip computation of a remaining number of the waveforms while the computed waveforms are memorized in the memory section, and that further operates in a second session for controlling the computing section to compute the remaining number of the waveforms; and an output section that can be enabled to concurrently generate the voices based on the designated number of the waveforms which are partly computed and memorized in the first session and partly computed in the second session.

4. An apparatus according to claim 3, wherein the controlling section controls the input section to commence a third session if the computing section is unable to complete the computation of the remaining number of the waveforms in the second session.

5. An apparatus according to claim 4, wherein the controlling section disables the output section in the second session to mute generation of the voices.

6. An apparatus according to claim 3, wherein the controlling section disables the output section in the first session to mute generation of the voices.

7. An apparatus according to claim 3, wherein the controlling section controls the input section to repeatedly commence silent sessions until the computation of the designated number of the waveforms completes while disabling the output section in each silent session to mute generation of the voices, and then controls the input section to commence an audible session while enabling the output section so as to concurrently generate the designated voices.

8. A music apparatus for processing a number of waveforms designated by performance information to concurrently generate the designated number of musical tones, the music apparatus comprising:

input means for inputting the performance information separately in a play session and a replay session;

computing means for synthesizing a limited number of the waveforms by computation in the play session according to the inputted performance information;

memory means for memorizing the waveforms synthesized by the computing means;

controlling means operative in the play session where the designated number exceeds the limited number for controlling the computing means to skip synthesis of a remaining number of the waveforms while the synthesized waveforms are memorized in the memory means, and being operative in the replay session for controlling the computing means to synthesize the remaining number of the waveforms; and output means for concurrently outputting the musical tones based on the designated number of the waveforms which are partly synthesized and memorized in the play session and partly synthesized in the replay session.

9. A music apparatus according to claim 8, wherein the controlling means comprises means for controlling the input means to commence a next replay session if the computing means has failed to complete the synthesis of the remaining number of the waveforms in the replay session.

10. A machine readable medium used in a music apparatus having a CPU for concurrently processing a number of waveforms designated by performance information to generate the designated number of musical tones, the medium containing program instructions executable by the CPU for causing the music apparatus to perform the steps of:

a play process which can concurrently process a limited number of the waveforms when the performance information is provided, and a replay process which can concurrently process the waveforms when the performance information is again provided, wherein the play process comprises the substeps of producing the limited number of the waveforms by computation while skipping a remaining number of the waveforms if the designated number exceeds the limited number, and memorizing the produced waveforms in a memory, and wherein the replay process comprises the substeps of producing the skipped number of the waveforms by computation while reproducing the memorized number of the waveforms by access to the memory to thereby provide the designated number of the waveforms, and generating the musical tones based on the provided waveforms.

11. A machine readable medium according to claim 10, wherein the steps further comprise a next replay process which is commenced if the replay process has failed to complete production of the skipped number of the waveforms by computation.

* * * * *